US012753544B2

(12) United States Patent
Leibman et al.

(10) Patent No.: US 12,753,544 B2
(45) **Date of Patent: *Oct. 6, 2026**

(54) LINT COLLECTION ASSEMBLY FOR A DRYER APPLIANCE

(71) Applicant: Haier US Appliance Solutions, Inc., Wilmington, DE (US)

(72) Inventors: Alexander B. Leibman, Prospect, KY (US); Sasikumar Durairaj, Hyderabad (IN); Jay Pareshbhai Shinde, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 500 days.

This patent is subject to a terminal disclaimer.

(21) Appl. No.: 18/366,290

(22) Filed: Aug. 7, 2023

(65) Prior Publication Data

US 2025/0051997 A1 Feb. 13, 2025

(51) Int. Cl.
*D06F 58/22* (2006.01)
*D06F 58/45* (2020.01)

(52) U.S. Cl.
CPC ..... *D06F 58/22* (2013.01); *D06F 58/45* (2020.02)

(58) Field of Classification Search
CPC ..... D06F 58/22; D06F 58/45
USPC ..... 34/82, 595–610
See application file for complete search history.

(56) References Cited

U.S. PATENT DOCUMENTS 4,314,409 A 2/1982 Cartier et al.
4,638,573 A 1/1987 Nakamura et al.
4,653,200 A 3/1987 Werner
4,700,492 A 10/1987 Werner et al.
4,720,925 A 1/1988 Czech et al.
5,157,848 A 10/1992 Dongelmans
5,664,339 A 9/1997 Swanson et al.
6,101,741 A 8/2000 Sears
6,305,843 B1 10/2001 Helmer
6,671,977 B2 1/2004 Beaumont
7,040,039 B1 5/2006 Stein et al.
(Continued)

FOREIGN PATENT DOCUMENTS

CN 217266524 U 8/2022
CN 121219463 A * 12/2025 ..... B08B 1/36
(Continued)

OTHER PUBLICATIONS

Banfield-Nwachi, Mabel, "Tumble dryers found to be a leading source of microfibre air pollution", The Guardian, https://www.theguardian.com/environment/2022/jan/12/tumble-dryers-leading-source-microfibre-air-pollution-hong-kong-plasgics, accessed Jan. 12, 2022, 3 pages.

*Primary Examiner* — Stephen M Gravini
(74) *Attorney, Agent, or Firm* — Dority & Manning, P.A.

(57) ABSTRACT

A dryer appliance includes a drum defining a chamber for receipt of clothes for drying, an air handler for urging a flow of air through the chamber, an exhaust conduit fluidly coupled to the chamber for discharging the flow of air, and a lint collection assembly operably coupled with the exhaust conduit. The lint collection assembly includes a filter housing defining a filter plenum, a filter frame positioned within the filter plenum, a lint filter mounted to the filter frame, and a filter cleaning mechanism operably coupled to the filter frame for periodically knocking collected lint off the lint filter under the force of the flow of air.

20 Claims, 6 Drawing Sheets

(56) References Cited

U.S. PATENT DOCUMENTS

| | | | | |
|---|---|---|---|---|
| 7,707,860 | B2 | 5/2010 | Hong et al. | |
| 7,886,458 | B2 * | 2/2011 | Blair | F26B 25/007 34/628 |
| 7,987,616 | B2 * | 8/2011 | Bae | D06F 58/203 68/5 R |
| 8,667,705 | B2 | 3/2014 | Shin et al. | |
| 8,789,290 | B2 | 7/2014 | Grunert | |
| 8,919,006 | B2 | 12/2014 | Arrigoni et al. | |
| 9,134,067 | B2 | 9/2015 | Ahn et al. | |
| 9,207,014 | B2 | 12/2015 | Ahn et al. | |
| 9,335,095 | B2 * | 5/2016 | Bison | D06F 39/12 |
| 9,834,882 | B2 | 12/2017 | Patil | |
| 10,273,627 | B2 * | 4/2019 | Yoon | D06F 58/20 |
| 10,400,385 | B2 * | 9/2019 | Brown | D06F 58/26 |
| 10,520,252 | B2 | 12/2019 | Momen et al. | |
| 10,704,189 | B2 * | 7/2020 | Christensen | D06F 58/04 |
| 11,260,329 | B2 | 3/2022 | Kim et al. | |
| 11,542,655 | B2 * | 1/2023 | Kim | D06F 58/04 |
| 12,331,451 | B2 * | 6/2025 | Leibman | D06F 58/04 |
| 2024/0084491 | A1 * | 3/2024 | Alarcon | D06F 37/065 |
| 2024/0229337 | A1 * | 7/2024 | Boado Encinosa | D06F 58/22 |
| 2025/0051997 | A1 * | 2/2025 | Leibman | D06F 58/45 |
| 2025/0075415 | A1 * | 3/2025 | Lim | D06F 58/22 |
| 2025/0207318 | A1 * | 6/2025 | Monsen | D06F 58/22 |

FOREIGN PATENT DOCUMENTS

| | | | | |
|---|---|---|---|---|
| EP | 0362738 | A2 | 4/1990 | |
| EP | 4692451 | A1 * | 2/2026 | B08B 1/36 |

* cited by examiner

LINT COLLECTION ASSEMBLY FOR A DRYER APPLIANCE

FIELD OF THE INVENTION

The present subject matter relates generally to dryer appliances, or more specifically, to systems and methods for collecting lint in a dryer appliance.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance. Dryer appliances may further include filter systems for removing foreign materials, such as lint, from passing into the exhaust conduit.

Notably, accumulation of lint in the filter systems may lead to reduced airflow through the dryer appliance and poor dryer performance. To compensate for the poor performance, cycle times may need to be increased, resulting in increased energy consumption, higher energy bills, and general consumer dissatisfaction. Moreover, lint build-up may present a fire hazard due to the potential for combustion. Thus, a user of a conventional dryer appliance must periodically remove the lint filter and manually clear the collected lint from the filter. However, it can be difficult and/or inconvenient to frequently remove lint from the filter, and certain consumers forget to regularly clean the filter and/or disregard the cleaning instructions. Moreover, lint cleaning by the user of the appliance may be skipped altogether, resulting in hazardous situations and poor dryer performance.

Accordingly, a dryer appliance with improved lint collection assemblies would be desirable. More specifically, a dryer appliance that includes a lint collection assembly for collecting and storing large amounts of lint without requiring frequent filter cleaning by a user would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a dryer appliance is provided including a cabinet, a drum rotatably mounted within the cabinet, the drum defining a chamber for receipt of clothes for drying, an air handler for urging a flow of air through the chamber, an exhaust conduit fluidly coupled to the chamber for discharging the flow of air, and a lint collection assembly operably coupled with the exhaust conduit. The lint collection assembly includes a filter housing defining a filter plenum, a filter frame positioned within the filter plenum, a lint filter mounted to the filter frame, and a filter cleaning mechanism operably coupled to the filter frame for periodically knocking collected lint off the lint filter.

In another exemplary embodiment, a lint collection assembly for a dryer appliance is provided. The dryer appliance includes a drum defining a chamber for receipt of clothes for drying, an air handler for urging a flow of air through the chamber, and an exhaust conduit fluidly coupled to the chamber for discharging the flow of air. The lint collection assembly includes a filter housing defining a filter plenum, a filter frame positioned within the filter plenum, a lint filter mounted to the filter frame, and a filter cleaning mechanism operably coupled to the filter frame for periodically knocking collected lint off the lint filter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
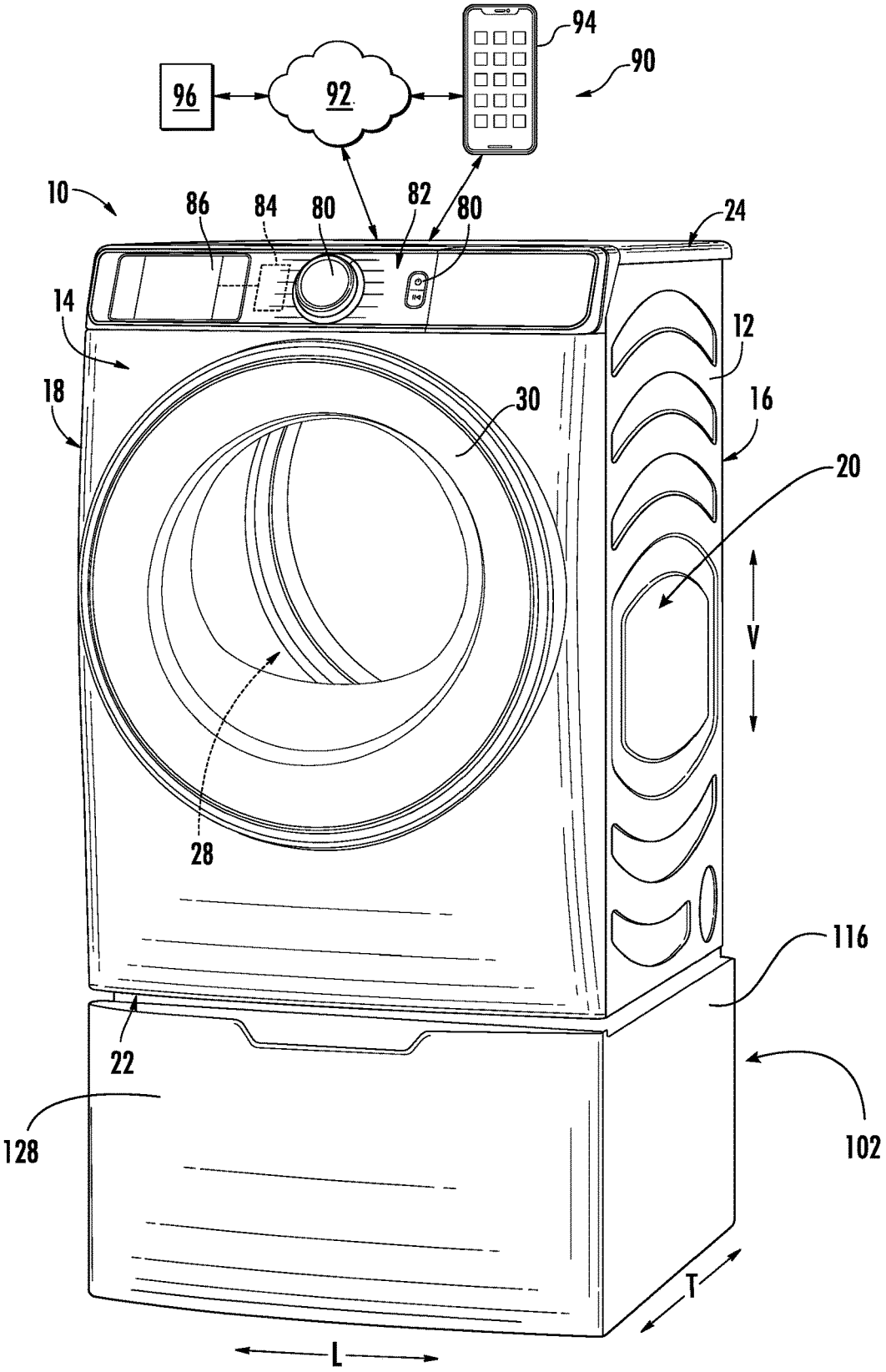
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
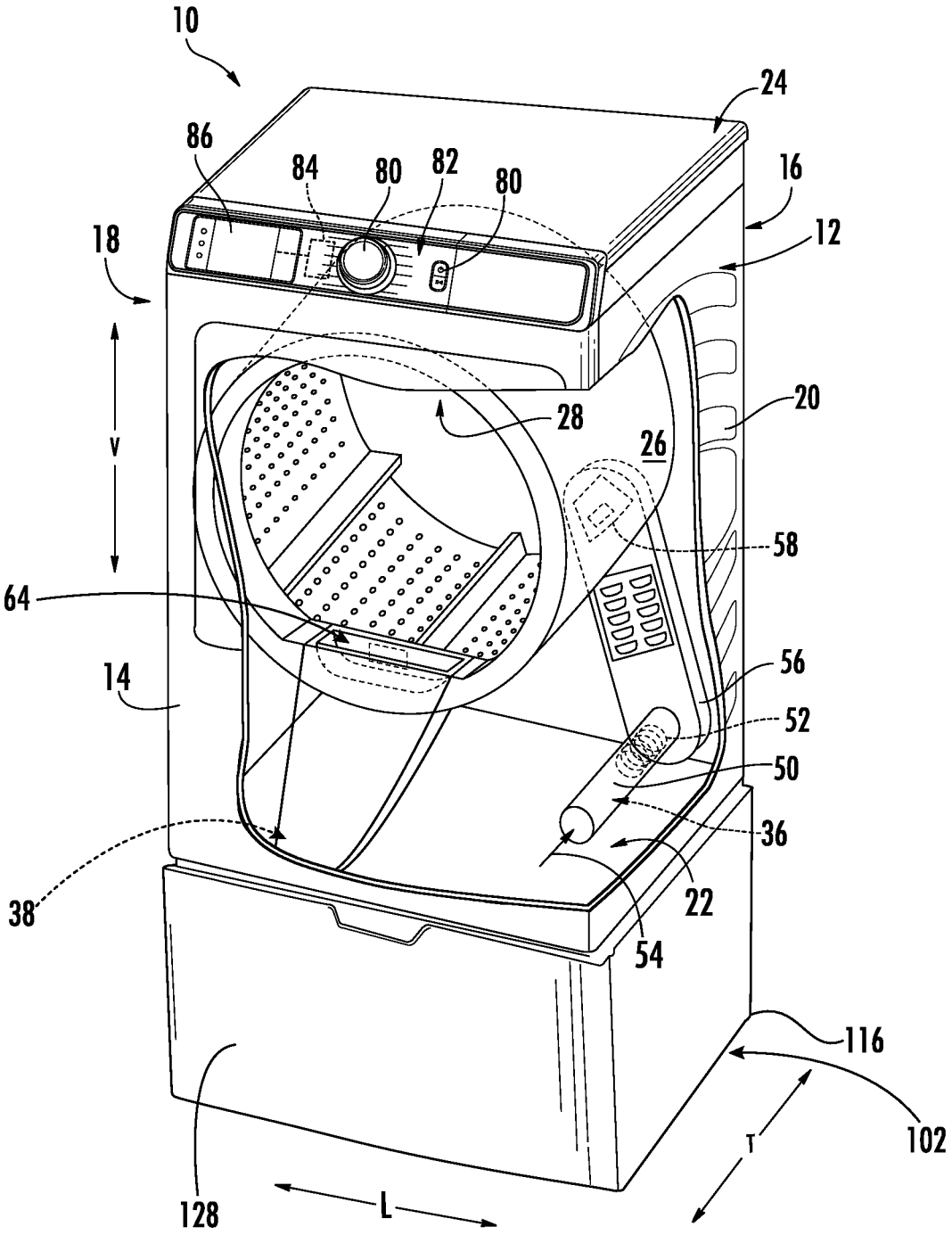
FIG. 2 provides a perspective view of the exemplary dryer appliance of FIG. 1 with portions of a cabinet of the exemplary dryer appliance removed to reveal certain components of the exemplary dryer appliance.

Referring now to the figures, FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances or laundry appliances having different appearances and different features may also be utilized with the present subject matter as well.

According to exemplary embodiments, dryer appliance 10 includes cabinet 12 that is generally configured for containing and/or supporting various components of dryer appliance 10 and which may also define one or more internal chambers or compartments of dryer appliance 10. In this regard, as used herein, the terms "cabinet," "housing," and the like are generally intended to refer to an outer frame or support structure for dryer appliance 10, e.g., including any suitable number, type, and configuration of support structures formed from any suitable materials, such as a system of elongated support members, a plurality of interconnected panels, or some combination thereof. It should be appreciated that cabinet 12 does not necessarily require an enclosure and may simply include open structure supporting various elements of dryer appliance 10. By contrast, cabinet 12 may enclose some or all portions of an interior of cabinet 12. It should be appreciated that cabinet 12 may have any suitable size, shape, and configuration while remaining within the scope of the present subject matter.

As illustrated, dryer appliance 10 generally defines a vertical direction V, a lateral direction L, and a transverse direction T, each of which is mutually perpendicular, such that an orthogonal coordinate system is generally defined. Cabinet 12 includes a front panel 14 and a rear panel 16 spaced apart along the transverse direction T, a pair of side panels 18 and 20 spaced apart from each other along the lateral direction L (e.g., extending between front panel 14 and rear panel 16), and a bottom panel 22 and a top panel 24 spaced apart along the vertical direction V.

Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

Figure 3:
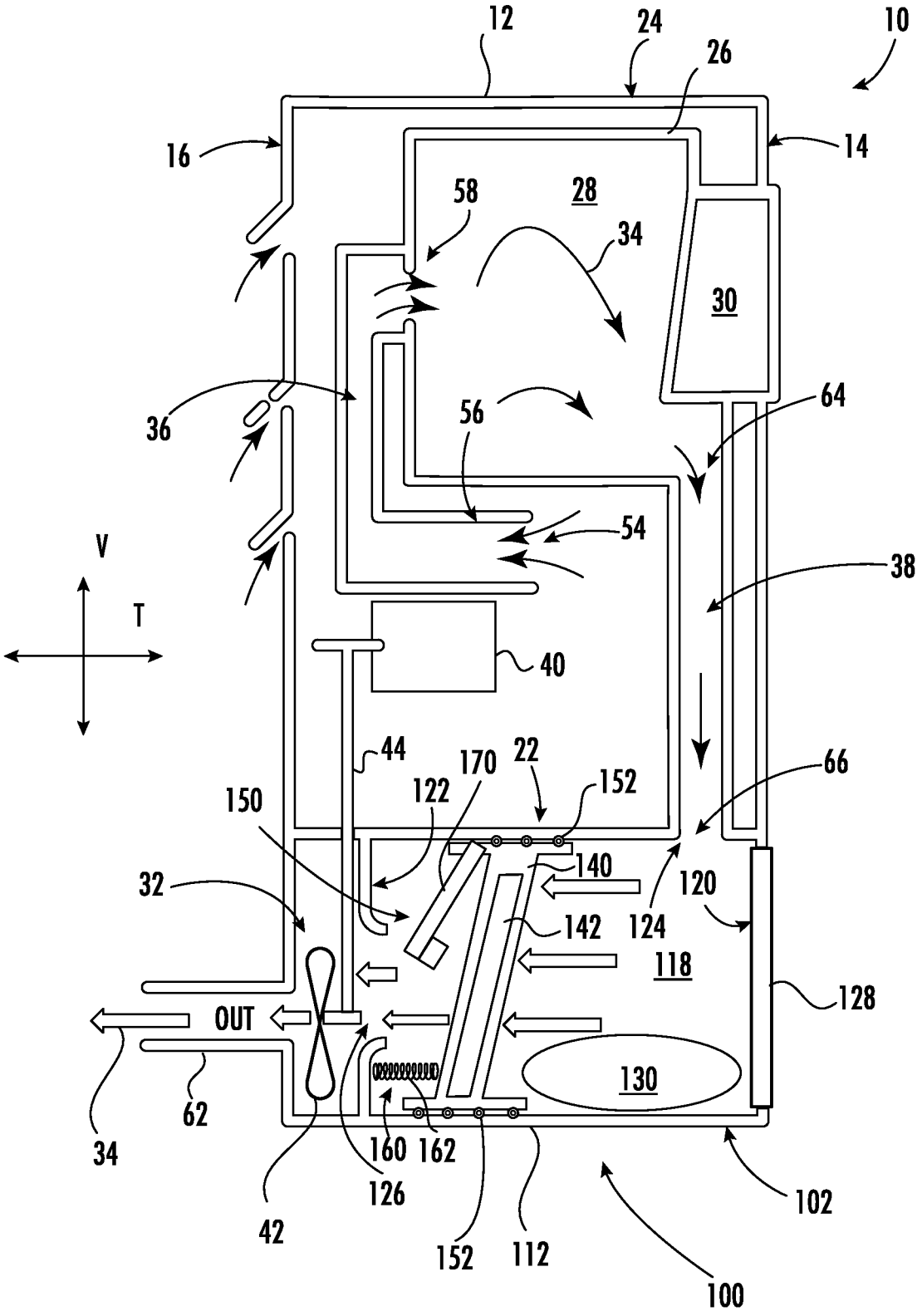
FIG. 3 provides a schematic view of a dryer appliance and a lint collection assembly that may be used with the exemplary dryer appliance of FIG. 1 according to an exemplary embodiment of the present subject matter.
Figure 4:
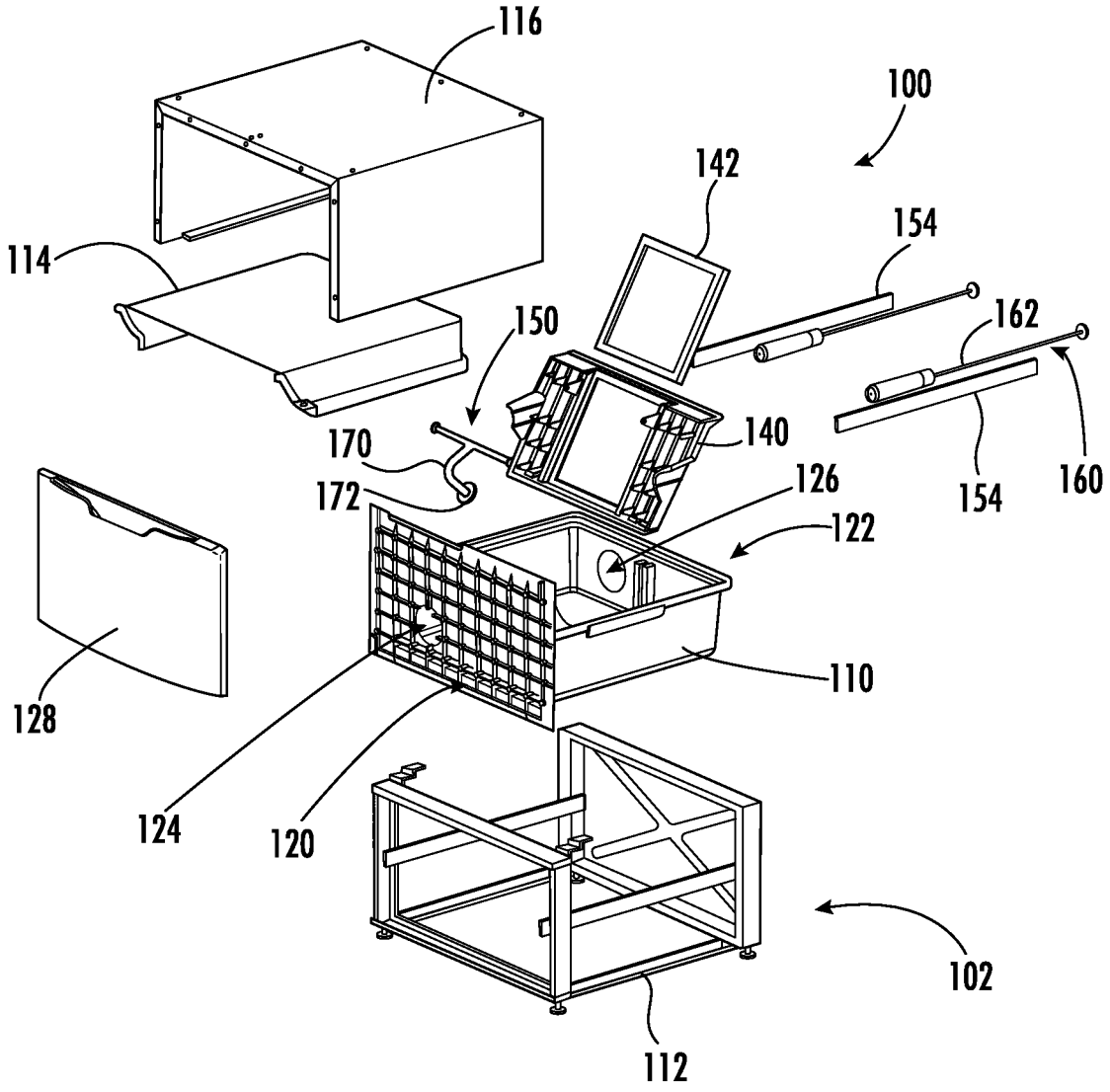
FIG. 4 provides an exploded view of the exemplary lint collection assembly of FIG. 3 according to an exemplary embodiment of the present subject matter.
Figure 5:
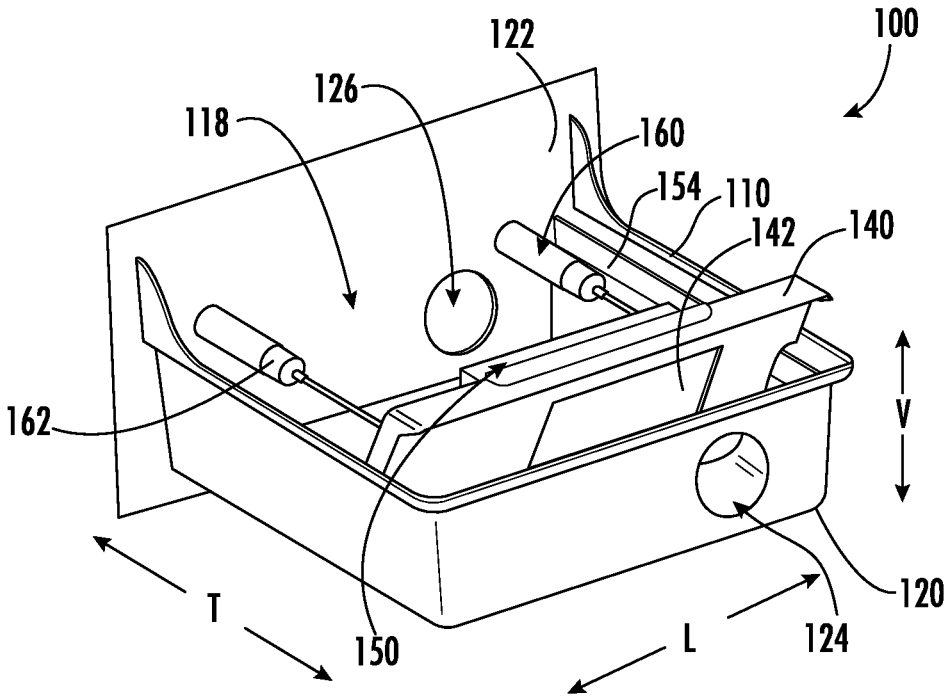
FIG. 5 provides a front perspective view of the exemplary lint collection assembly of FIG. 3 according to an exemplary embodiment of the present subject matter.
Figure 6:
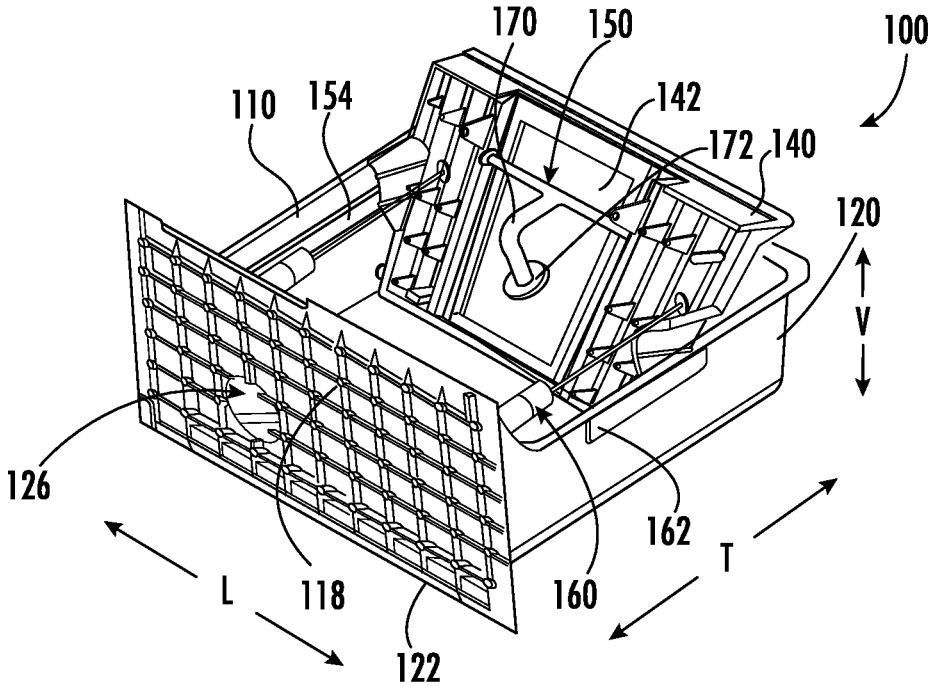
FIG. 6 provides a rear perspective view of the exemplary lint collection assembly of FIG. 3 according to an exemplary embodiment of the present subject matter.

Referring now briefly to FIG. 3, an air handler 32, such as a blower or fan, may be provided to motivate an airflow (e.g., identified herein generally by reference numeral 34) through an entrance air passage 36 and an air exhaust passage 38. Specifically, air handler 32 may include a motor 40 which may be in mechanical communication with a blower fan 42, such that motor 40 rotates blower fan 42. For example, motor 40 may be mechanically coupled to blower fan 42 via a drive belt 44 or any other suitable mechanical coupling. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 42 of air handler 32 independently of drum 26.

Drum 26 may be configured to receive heated air that has been heated by a heating assembly 50, e.g., in order to dry damp articles disposed within chamber 28 of drum 26. Heating assembly 50 includes a heater 52 that is in thermal communication with chamber 28. For instance, heater 52 may include one or more electrical resistance heating elements or gas burners, for heating air being flowed to chamber 28. As discussed above, during operation of dryer appliance 10, motor 40 rotates fan 42 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 36, including inlet duct 56, to drum 26. The heated air enters drum 26 through an outlet 58 of inlet duct 56 positioned at a rear wall of drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines air exhaust passage 38 fluidly coupled to chamber 28. More specifically, air exhaust passage 38 extends between an exhaust inlet 64 and an exhaust outlet 66 (see, e.g., FIG. 3). According to the illustrated embodiment, exhaust inlet 64 is positioned at chamber 28 adjacent door 30 and exhaust outlet 66 is defined in bottom panel 22 of cabinet 12, though other routing of air exhaust passage 38 are possible and within the scope of the present subject matter. During a dry cycle, internal air flows from chamber 28 through air exhaust passage 38 to air handler 32, e.g., as an outlet flow portion of airflow 34. As shown, air further flows through air handler 32 and to an exhaust conduit 62.

As shown in FIG. 3, the internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment. As will be discussed in more detail below, a lint collection assembly 100 may be positioned between air exhaust passage 38 and exhaust conduit 62 for removing and collecting lint from the flow of air 34.

One or more selector inputs 80, such as knobs, buttons, touchscreen interfaces, etc., may be provided on a user interface panel 82 and may be in communication with a processing device or controller 84. Signals generated in controller 84 operate motor 40, heating assembly 50, and other system components in response to the position of selector inputs 80. Additionally, a display 86, such as an indicator light or a screen, may be provided on cabinet user interface panel 82. Display 86 may be in communication with controller 84 and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance. For example, dryer appliance 10 may include one or more temperature sensors which are generally operable to measure internal temperatures in dryer appliance 10 and/or one or more airflow sensors which are generally operable to detect the velocity of air (e.g., as an air flow rate in meters per second, or as a volumetric velocity in cubic meters per second) as it flows through the appliance 10. In some embodiments, controller 84 is configured to vary operation of heating assembly 50 based on one or more temperatures detected by the temperature sensors or air flow measurements from the airflow sensors.

Referring still to FIG. 1, a schematic diagram of an external communication system 90 will be described according to an exemplary embodiment of the present subject matter. In general, external communication system 90 is configured for permitting interaction, data transfer, and other communications with dryer appliance 10. For example, this communication may be used to provide and receive operating parameters, cycle settings, performance characteristics, user preferences, user notifications, or any other suitable information for improved performance of dryer appliance 10.

External communication system 90 permits controller 84 of dryer appliance 10 to communicate with external devices either directly or through a network 92. For example, a consumer may use a consumer device 94 to communicate directly with dryer appliance 10. For example, consumer devices 94 may be in direct or indirect communication with dryer appliance 10, e.g., directly through a local area network (LAN), Wi-Fi, Bluetooth, Zigbee, etc. or indirectly through network 92. In general, consumer device 94 may be any suitable device for providing and/or receiving communications or commands from a user. In this regard, consumer device 94 may include, for example, a personal phone, a tablet, a laptop computer, or another mobile device.

In addition, a remote server 96 may be in communication with dryer appliance 10 and/or consumer device 94 through network 92. In this regard, for example, remote server 96 may be a cloud-based server 96, and is thus located at a distant location, such as in a separate state, country, etc. In general, communication between the remote server 96 and the client devices may be carried via a network interface using any type of wireless connection, using a variety of communication protocols (e.g., TCP/IP, HTTP, SMTP, FTP), encodings or formats (e.g., HTML, XML), and/or protection schemes (e.g., VPN, secure HTTP, SSL).

In general, network 92 can be any type of communication network. For example, network 92 can include one or more of a wireless network, a wired network, a personal area network, a local area network, a wide area network, the internet, a cellular network, etc. According to an exemplary embodiment, consumer device 94 may communicate with a remote server 96 over network 92, such as the internet, to provide user inputs, transfer operating parameters or performance characteristics, receive user notifications or instructions, etc. In addition, consumer device 94 and remote server 96 may communicate with dryer appliance 10 to communicate similar information.

External communication system 90 is described herein according to an exemplary embodiment of the present subject matter. However, it should be appreciated that the exemplary functions and configurations of external communication system 90 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Referring now also generally to FIGS. 3 through 8, a lint collection assembly 100 that may be used with dryer appliance 10 will be described according to exemplary embodiments of the present subject matter. As explained above, during operation of dryer appliance 10, the flow of air 34 circulated through chamber 28 to dry the load of clothes will entrain or contain various lint, fabric particles, or other debris that are exhausted through air exhaust passage 38. Lint collection assembly 100 may remove this lint instead of discharging it from the dryer appliance 10. Lint collection assembly 100 thus collects the lint for quick and easy removal and disposal, as will be described in more detail below.

According to exemplary embodiments, such as the example embodiment illustrated in FIGS. 1 through 3, dryer appliance may further include a dryer pedestal 102. Dryer pedestal 102 may be used to elevate the working components of dryer appliance 10 such that they are easier to access by a user of dryer appliance 10. In addition, according to the illustrated embodiment, lint collection assembly 100 may generally be housed within dryer pedestal 102. Although an exemplary lint collection assembly 100 is described herein as being positioned within dryer pedestal 102 of dryer appliance 10, it should be appreciated that aspects of the present subject matter may utilize different numbers, types, and configurations of filter assemblies oriented within dryer appliances at other locations.

As illustrated, lint collection assembly 100 generally includes a filter housing 110 that is positioned within a pedestal frame 112 and is covered by a lid 114 and a pedestal cover 116 to generally define a filter plenum 118. Filter housing 110 may include a front wall 120 and a rear wall 122 spaced apart along the transverse direction T. Lint collection assembly 100 may further include an intake aperture 124 for receiving the flow of air 34 from air exhaust passage 38 and a discharge aperture 126 for discharging the flow of air 34 from dryer appliance 10 through exhaust conduit 62. For example, according to the embodiment illustrated in FIGS. 4 through 7, intake aperture 124 is defined within front wall 120 and discharge aperture 126 is defined within rear wall 122. By contrast, according to the schematic illustration of FIGS. 3 and 8, intake aperture 124 may alternatively be defined through lid 114 and pedestal cover 116.

Dryer pedestal 102 may further include a front panel 128 through which a user may access filter plenum 118. In this regard, for example, front panel 128 may be pivotally mounted to pedestal frame 112 such that a user may periodically access filter plenum 118 to remove collected lint 130 (see e.g., FIGS. 3 and 8). According to still other embodiments, filter housing 110 may be slidably mounted within pedestal frame 112 such that a user may use front panel 128 to pull pedestal frame 112 out for lint collection. According to the illustrated embodiment, the flow of air 34 generally passes into filter plenum 118 through intake aperture 124 and passes out of discharge aperture 126 directly into exhaust conduit 62. In addition, according to the illustrated embodiment, air handler 32 is positioned proximate discharge aperture 126 such that filter frame 140 is positioned between air handler 32 and intake aperture 124. In this manner, lint 130 may be extracted from the flow of air 34 prior to passing through air handler 32.

As illustrated, lint collection assembly 100 further comprises a filter frame 140 that is positioned within filter plenum 118 and a lint filter 142 that is mounted to filter frame 140. In general, lint filter 142 may be any suitable number, type, and configuration of air filtration devices. For example, lint filter 142 may include a pleated filter media, a mesh filter media, a sponge, a HEPA filter, an electrostatic filter, a spun glass filter, or any other suitable type and size of filter medium. In addition, air filter may have any suitable minimum efficiency reporting value (MERV) rating. Notably, by positioning lint collection assembly 100 and dryer pedestal 102, conventional household size air filters may be used. For example, lint filter 142 may be 12"×12"×1" filter or may have any other suitable conventional air filter size.

According to the illustrated embodiment, filter frame 140 may be generally configured for supporting lint filter 142 at an angle relative to the vertical direction V. In this regard, lint filter 142 may be angled at between about 1 and 70 degrees, between about 20 and 60 degrees, between about 30 and 50 degrees, or at about 45 degrees measured relative to the vertical direction V. In this manner, collected lint 130 may have a tendency to fall off lint filter 142 after being extracted from the flow of air 34, particularly when lint filter 142 is agitated as described in more detail below.

Notably, during operation of dryer appliance, lint filter 142 may generally extract lint 130 from the flow of air 34. As explained briefly above, it may be desirable to periodically remove collected lint 130, e.g., to increase efficiency, improve drying performance, and reduce fire hazards. However, conventional filter assemblies require a user to clean the lint filter after every operating cycle. Such frequent filtering may be undesirable by the user and may not be performed at all due to inconvenience. Accordingly, advantageous aspects of the presently disclosed lint filter assembly 100 include the ability to decrease the frequency of filter cleaning while also compacting lint 130 for easier removal.

Accordingly, lint collection assembly 100 may generally include a filter cleaning mechanism 150 that is configured for facilitating removal of lint 130 from lint filter 142 without requiring user intervention. For example, filter cleaning mechanism 150 may be generally configured for periodically knocking collected lint 130 off of lint filter 142 or otherwise agitating lint filter 142. Although exemplary filter cleaning mechanisms 150 are described below, it should be appreciated that variations and modifications to such mechanisms may be used while remaining within the scope of the present subject matter.

Referring now specifically to the embodiment illustrated in FIGS. 3 through 7, filter frame 140 of lint collection assembly 100 may generally be movable between a first position when the flow of air 34 is passing through the filter plenum 118 and a second position when the flow of air 34 is stopped. In this regard, for example, filter frame 140 may be slidably mounted in filter housing 110 by using a plurality of rollers 152 (e.g., as shown schematically in FIG. 3). According to still other embodiments, filter frame 140 may be slidably supporting through a plurality of slide rails 154 mounted on the sides of filter housing 110 (e.g., as shown in FIGS. 4 through 7). In this manner, filter frame 140 may slide easily along the transverse direction T within filter plenum 118.

Referring still generally to FIGS. 3 through 7, lint collection assembly 100 may further include a resilient element 160 that is operably coupled to filter frame 140 for urging filter frame 140 to the second position. For example, according to the illustrated embodiment, resilient element 160 may include to mechanical springs 162 that urge filter frame 140 away from discharge aperture 126 of filter housing 110. In this regard, when the flow of air 34 is passing through filter plenum 118, the force of air may push filter frame 140 to the first position (e.g., as shown schematically in FIG. 3), thereby compressing mechanical springs 162. By contrast, when the flow of air 34 has stopped, mechanical springs 162 may urge filter frame 140 back to the second position.

Notably, the movement of the filter frame 140 between the first position in the second position may generally help to compact lint 130 that has been removed from lint filter 142. In this regard, movement of filter frame 140 from the first position toward the second position may compress lint 130 and push the lint 140 toward a front bottom of filter plenum 118. In this manner, the collected lint 130 does not affect the airflow 34 through filter plenum 118 and may be easier to collect by a user of dryer appliance 100.

Figure 7:
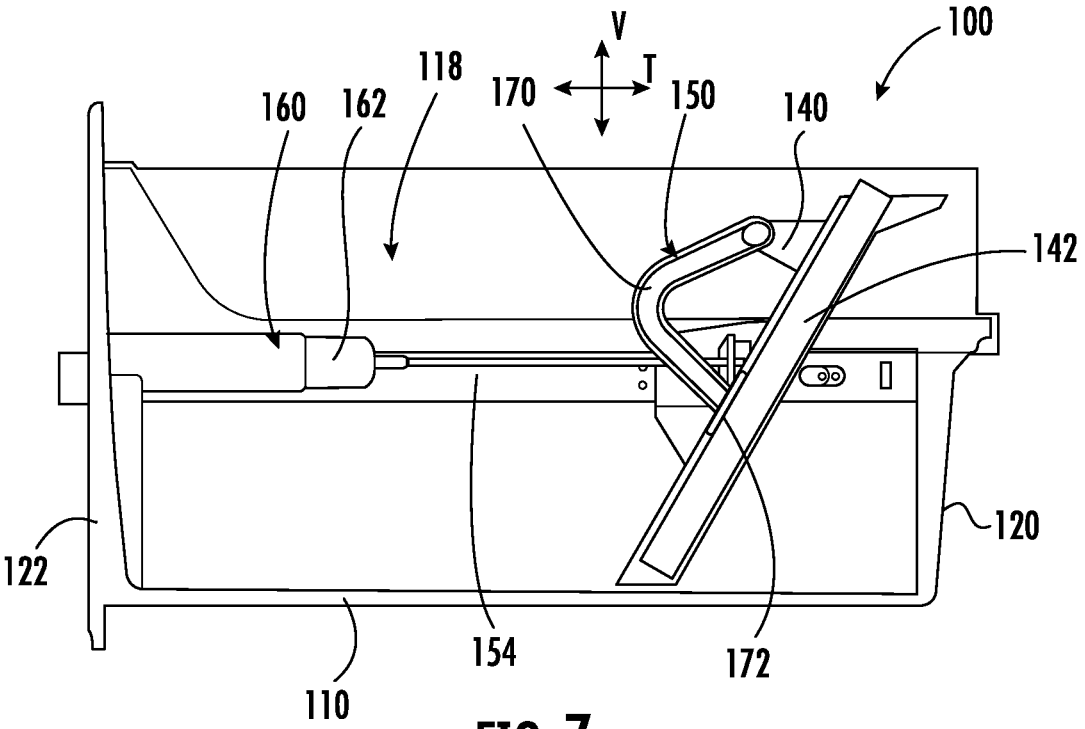
FIG. 7 provides a cross-sectional side view of the exemplary lint collection assembly of FIG. 3 according to an exemplary embodiment of the present subject matter.

According to example embodiments illustrated in FIGS. 3 through 7, filter cleaning mechanism 150 may generally include a striking element 170 that is pivotally mounted to filter frame 140 and that is movable between a raised position (e.g., as shown in FIG. 3) and a lowered position (e.g., as shown in FIG. 7). In general, movement of striking element 170 from the raised position to the lowered position may agitate lint filter 142 to an extent that collected lint 130 may be discharged from lint filter 142 and may be collected in the bottom of filter plenum 118.

According to example embodiments, striking element 170 may be generally configured for pivoting under the force of the flow of air 34. In this regard, for example, striking element 170 may include an enlarged striking surface 172 that interacts with the flow of air 34. In this regard, operation of air handler 32 and the tumbling of clothes within drum 26 may generally cause a fluttering or inconsistent airflow 34. This airflow 34 may push against striking surface 172 and cause striking element 172 periodically move from the raised to the lowered position, thereby striking lint filter 142 and discharging any collected lint 130.

Notably, in addition to operating under the force of the flow of air 34, striking element 170 may also discharge lint 130 due to the momentum of filter frame 140 moving from the first to the second position. In this regard, movement of the filter frame 140 may cause striking element 170 to move toward the raised position and the stopping of filter frame 140 in the second position may cause the momentum of striking element 170 to impact lint filter 142, thereby dislodging stubborn lint 130.

Figure 8:
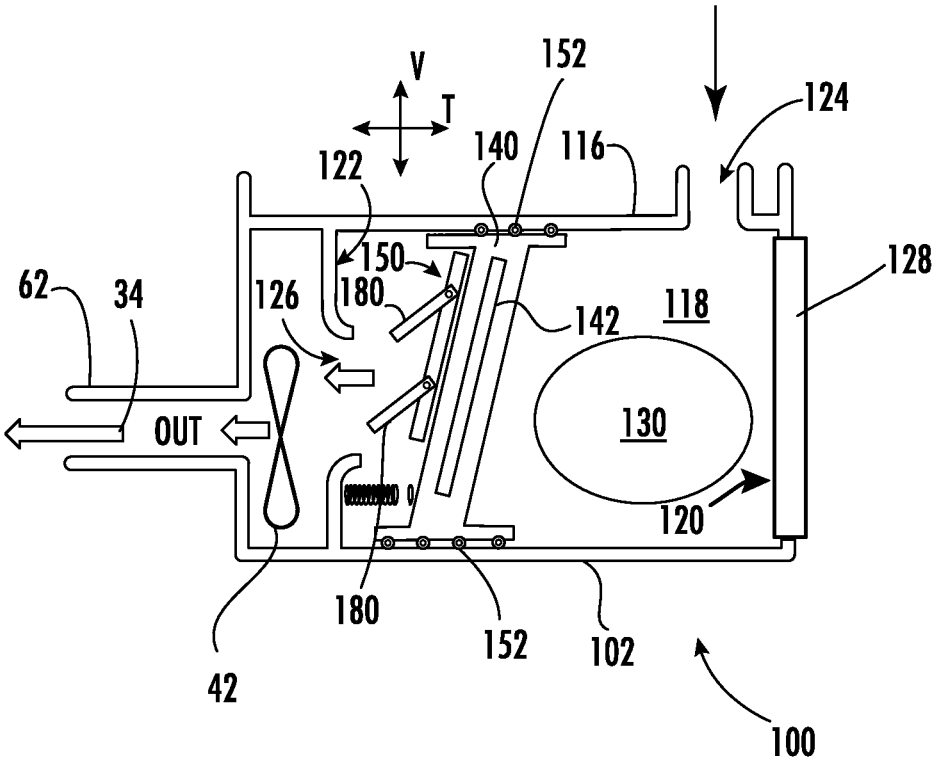
FIG. 8 provides a schematic view of a lint collection assembly that may be used with the exemplary dryer appliance of FIG. 1 according to another exemplary embodiment of the present subject matter.

Referring now briefly to FIG. 8, an alternative filter cleaning mechanism 150 will be described according to exemplary embodiments of the present subject matter. According to this illustrated embodiment, instead of using striking element 170, cleaning mechanism 150 may include one or more louvers 180 that are pivotally mounted over the lint filter 142. Accordingly, turbulence in the flow of air 34 may cause the one or more louvers 180 to pivot and strike the lint filter 142 to knock the collected lint 130 off the lint filter 142. It should be appreciated that any suitable number, size, and weight of louvers 180 may be used remaining within the scope present subject matter.

As explained herein, aspects of the present subject matter are generally directed to a dryer lint filter assembly (e.g., positioned in a pedestal drawer) with a mechanical separator to detach lint from the filter. The mechanical separator (articulated louvers, flappers, or a filter beater) may be mounted between a fan and the lint filter, and it flutters due to the air stream. The airstream may be unsteady due to the tumbling of clothes. Therefore, the mechanical separator can beat the lint filter under the influence of airstream to detach lint from the filter. Further, the separator may work as a louver and prevents outside cold or hot air from entering the dryer.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dryer appliance, comprising:
- a cabinet;
- a drum rotatably mounted within the cabinet, the drum defining a chamber for receipt of clothes for drying;
- an air handler for urging a flow of air through the chamber;
- an exhaust conduit fluidly coupled to the chamber for discharging the flow of air; and
- a lint collection assembly operably coupled with the exhaust conduit, the lint collection assembly comprising:
  - a filter housing defining a filter plenum;
  - a filter frame positioned within the filter plenum;
  - a lint filter mounted to the filter frame; and
  - a filter cleaning mechanism operably coupled to the filter frame for periodically knocking collected lint off the lint filter.

2. The dryer appliance of claim 1, wherein the filter frame is movable between a first position when the flow of air is passing through the filter plenum and a second position when the flow of air is stopped, and wherein the lint collection assembly further comprises:
- a resilient element operably coupled to the filter frame for urging the filter frame to the second position.

3. The dryer appliance of claim 2, wherein the resilient element is a mechanical spring that urges the filter frame away from a discharge aperture of the filter housing.

4. The dryer appliance of claim 2, wherein the lint collection assembly further comprises:
- a plurality of rollers slidably supporting the filter frame within the filter housing.

5. The dryer appliance of claim 1, wherein the lint collection assembly further comprises:
- a plurality of slide rails slidably supporting the filter frame within the filter housing.

6. The dryer appliance of claim 1, wherein the filter cleaning mechanism comprises:
- a striking element pivotally mounted to the filter frame and being movable between a raised position and a lowered position to knock the collected lint off the lint filter.

7. The dryer appliance of claim 6, wherein the striking element comprises an enlarged striking surface that interacts with the flow of air to move the striking element between the raised position and the lowered position.

8. The dryer appliance of claim 1, wherein the filter cleaning mechanism comprises:
- one or more louvers pivotally mounted over the lint filter, wherein turbulence in the flow of air causes the one or more louvers to pivot and strike the lint filter to knock the collected lint off the lint filter.

9. The dryer appliance of claim 1, wherein the filter cleaning mechanism is actuated by the flow of air.

10. The dryer appliance of claim 1, wherein the lint filter is supported in the filter frame at an angle relative to a vertical direction.

11. The dryer appliance of claim 1, wherein the lint filter is 12 inches by 12 inches by 1 inch.

12. The dryer appliance of claim 1, wherein the filter housing defines an intake aperture and a discharge aperture, wherein the air handler is positioned proximate the discharge aperture such that the filter frame is positioned between the air handler and the intake aperture.

13. The dryer appliance of claim 1, wherein the dryer appliance further comprises:

a dryer pedestal, wherein the lint collection assembly is mounted within the dryer pedestal of the dryer appliance.

14. A lint collection assembly for a dryer appliance, the dryer appliance comprising a drum defining a chamber for receipt of clothes for drying, an air handler for urging a flow of air through the chamber, and an exhaust conduit fluidly coupled to the chamber for discharging the flow of air, the lint collection assembly comprising:

a filter housing defining a filter plenum;

a filter frame positioned within the filter plenum;

a lint filter mounted to the filter frame; and a filter cleaning mechanism operably coupled to the filter frame for periodically knocking collected lint off the lint filter.

15. The lint collection assembly of claim 14, wherein the filter frame is movable between a first position when the flow of air is passing through the filter plenum and a second position when the flow of air is stopped, and wherein the lint collection assembly further comprises:

a resilient element operably coupled to the filter frame for urging the filter frame to the second position.

16. The lint collection assembly of claim 15, wherein the resilient element is a mechanical spring that urges the filter frame away from a discharge aperture of the filter housing.

17. The lint collection assembly of claim 15, wherein the lint collection assembly further comprises:

a plurality of rollers slidably supporting the filter frame within the filter housing.

18. The lint collection assembly of claim 14, wherein the lint collection assembly further comprises:

a plurality of slide rails slidably supporting the filter frame within the filter housing.

19. The lint collection assembly of claim 14, wherein the filter cleaning mechanism comprises:

a striking element pivotally mounted to the filter frame and being movable between a raised position and a lowered position to knock the collected lint off the lint filter.

20. The lint collection assembly of claim 14, wherein the filter cleaning mechanism comprises:

one or more louvers pivotally mounted over the lint filter, wherein turbulence in the flow of air causes the one or more louvers to pivot and strike the lint filter to knock the collected lint off the lint filter.

* * * * *